United States Patent [19]

Werner et al.

[11] 4,014,807

[45] Mar. 29, 1977

[54] SHAPED WASHING AGENTS HAVING AN IMPROVED RESISTANCE TO CRACKING

[75] Inventors: Lothar Werner, Krefeld-Bockum; Albert Weingartz, Moers; Jutta Trautvetter, Rheydt, all of Germany

[73] Assignee: Henkel & Cie G.m.b.H., Dusseldorf-Holthausen, Germany

[22] Filed: June 4, 1975

[21] Appl. No.: 583,670

[30] Foreign Application Priority Data

June 10, 1974 Germany ..... 2427986

[52] U.S. Cl. ..... 252/132; 252/89 R; 252/134; 252/174; 252/DIG. 16

[51] Int. Cl.[2] ..... C11D 3/30; C11D 17/00

[58] Field of Search ..... 252/90, 122, 132, 134, 252/174, DIG. 16

[56] References Cited

UNITED STATES PATENTS

| | | | |
|---|---|---|---|
| 2,061,468 | 11/1936 | Kling | 252/DIG. 16 |
| 2,166,315 | 7/1939 | Martin | 252/550 |
| 2,414,098 | 1/1947 | Garvey et al. | 252/134 |
| 2,792,348 | 5/1957 | Ayleworth | 252/132 |
| 3,129,187 | 4/1964 | Meehan | 252/DIG. 16 |
| 3,186,948 | 6/1965 | Sweeney | 252/DIG. 16 |
| 3,294,692 | 12/1966 | Kelly et al. | 252/134 |

*Primary Examiner*—Harris A. Pitlick

*Attorney, Agent, or Firm*—Hammond & Littell

[57] ABSTRACT

Shaped washing agents based on synthetic detergents and/or soaps containing from 1 to 10% by weight, based on the total composition of a compound supplying resistance to cracking selected from the group consisting of branched-chain alkanols having from 12 to 20 carbon atoms and di-octyl adipate having up to 50% of n-octyl groups.

9 Claims, No Drawings

SHAPED WASHING AGENTS HAVING AN IMPROVED RESISTANCE TO CRACKING

The tendency of cleaning or washing agents in a shaped, particularly tablet, form, especially those based on soap, to form cracks when repeatedly moistened and dried during use is universally known. This disturbing characteristic is particularly evident in the case of those colored tablets or bars of cleaning agents which have been pressed parallel to the direction of the color strands or ribbons in the extruded product in order to produce symmetrical color patterns. There was therefore a universal desire to provide tablets or bars of cleaning agents wherein the tendency to form cracks was completely eliminated or at least substantially repressed.

An object of the present invention is the development of washing or cleaning agents shaped in the form of tablets, cakes or bars which are based on synthetic detergents and/or soaps and which have a reduced tendency to form cracks when repeatedly moistened and dried during use.

Another object of the present invention is the developement of shaped washing agents based on wash active substances selected from the group consisting of synthetic detergents and soaps consisting essentially of (A) from 54 to 94% by weight of said wash active substances, (B) from 0 to 40% by weight of nonwash active substances customarily incorporated in shaped washing agents, (C) from 5 to 15% water and (D) from 1 to 10% by weight, of a compound supplying resistance to cracking selected from the group consisting of branched-chain alkanols having from 12 to 20 carbon atoms and di-octyl adipate having up to 50% of n-octyl.

These and other objects of the invention will become more apparent as the description thereof proceeds.

We have now discovered that shaped tablets, cakes or bars of cleaning or washing agents, which contain from 1 to 10% by weight of the total composition of a branch-chained aliphatic alcohol and/or di-octyl adipate, said branch-chain, aliphatic alcohol having 12 to 20 carbon atoms in the molecule, best meet this requirement for improved resistance to cracking.

According to the present invention there is provided a cleaning agent in tablet form and based on soap or synthetic detergents, which contain from 1 to 10% by weight of a branch-chain, aliphatic alcohol and/or di-octyl adipate, said branch-chain, aliphatic alcohol having 12 to 20 carbon atoms in the molecule. More particularly the present invention resides in shaped washing agents based on wash active substances selected from the group consisting of synthetic detergents and soaps consisting essentially of (A) from 54 to 94% by weight of said wash active substances, (B) from 0 to 40% by weight of non-wash active substances customarily incorporated in shaped washing agents, (C) from 5 to 15% water and (D) from 1 to 10% by weight, of a compound supplying resistance to cracking selected from the group consisting of branched-chain alkanols having from 12 to 20 carbon atoms and di-octyl adipate having up to 50% of n-octyl.

The branch-chained aliphatic alcohols, preferably alkanols having 12 to 20 carbon atoms in the molecule, which are to be used to eliminate the formation of cracks, and also di-octyl adipate are universally known commercial products. They may be produced in various ways from saturated or unsaturated aliphatic hydrocarbons or, by way of the Guerbet reaction, from aliphatic alcohols of corresponding chain lengths, or alternatively by complete esterification of adipic acid with an octanol mixture containing up to 50% of n-octanol.

Examples of products to be used in accordance with the present invention are isotridecyl alcohol, branch-chained hexadecyl alcohol from petrochemistry, 2-hexyldecanol, iso-octadecyl alcohol, 2-octyl-dodecanol and di-octyl adipate comprising 50% n-octyl and 50% iso-octyl.

The product to be used in accordance with the present invention to inhibit the formation of cracks are added to the tablets of cleaning agents in quantity of from 1 to 10% by weight. In this connection, it has become evident that satisfactory results are achieved in the case of tablets of cleaning agents based on synthetic surfactants which contain the crack-checking additives in quantities as low as 1 to 3% by weight, while those cleaning agents based on soap require larger additions. The preferred additive amount for tablets of cleaning agents based on soap is from 4 to 6% by weight.

The synthetic detergents or syndets are commercial products having an active washing effect which are produced synthetically. Preferably they are anionic surface-active compounds of the sulfonate and sulfate type which are solid at temperatures below 70° C. They are more particularly disclosed in U.S. Pat. No. 3,862,965.

In addition to the above-stated branch-chained aliphatic alcohols and/or di-octyl adipate, which are added to eliminate the tendency to form cracks, the tablets of cleaning agents can also contain other conventional constituents in amounts of from 0 to 40% by weight.

These include super-fatting agents, skin-protection substances and binding agents, protein hydrolysates, starch derivatives, cellulose glycolates and polyglycols. Further substances which may be added are scents and frequently coloring matter and and opacifiers. Free fatty acids, fatty alcohols, lanolin and fatty acid mono- and dialkylamides are especially used as additives to shaped washing agents, particularly those based on the synthetic detergents.

Another frequent additive to shaped washing agents are stabilizers having a complexing effect. These stabilizers include the alkali metal salts of nitrilotriacetic acid, ethylenediaminetetraacetic acid, diethylenetriaminepentaacetic acid, 1-hydroxyethane-1,1-diphosphonic acid, aminotri-(methylenephosphonic acid), ethylenediaminetetra-(methylenephosphonic acid), methylenediphosphonic acid, ethylenediphosphonic acid, and the higher homologues of the above carboxylic and phosphonic acids. They can be used in a quantity of up to 1%, based on the total composition.

In order to brighten the soap or base substance of the tablets of cleaning agents, optical brightening agents may also be added, in particular those from the class of bis-(triazinyl)-4,4'-stilbene-disulfonic acid derivatives and of naphthotriazolstilbene-sulfonic acid derivatives and of the substituted 1,3-diphenyl pyrazolines. These likewise can be added in amounts of up to 1% by weight based on the total composition.

The tablets of cleaning agents may also contain bactericidal substances, such as 2,2'-dihydroxy-3,5,6,3',-5',6'-hexachloro-diphenyl-methane, 2-hydroxy-2',4,4'-trichloro-diphenylether, 3,5,3',5'-tetrachloro-2,2'-dihydroxy-diphenyl,3,4,4'-trichlorocarbanilide, trifluoro-methylcarbanilide, tetramethylthiuramdisulfide and chlorinated or brominated salicylic acid anilides, e.g. 3,5,4'-tribromosalicyl anilide. Mixtures of the abovementioned bactericides may also be used. They can be used, when present, in a quantity ranging from 0.05 to 3% by weight, with respect to the tablets of cleaning agents. To give color stabilization it is also possible for reducing agents, such as sodium sulfite, sodium pyrosulfite, sodium dithionite, sodium thiosulfate or salts of hydrazine to be added to the soaps containing bactericides.

Other suitable mixture constituents of the tablets of cleaning agents are alkali metal silicates, alkali metal borates and polymeric alkali metal phosphates, particularly sodium tripolyphosphate, which substances may be present in minor quantities so that the mass remains plasticizable and during storage or use does not exhibit any salt efflorescences.

Soaps are most suitable as the wash active substances of the tablets of cleaning agents of the present invention, and comprise the sodium salts of fatty acids of natural or synthetic origin having 8 to 20, preferably 12 to 18 carbon atoms, and also mixtures thereof with resinic acids. Examples thereof are soaps obtained from coconut or tallow fatty acids. Soaps can also be used which are derived from the fatty acids of olive oil, palm kernel oil, tall oil, soya bean oil, cotton-seed oil, peanut oil or sunflower-seed oil; the unsaturated portions contained in these fatty acids may in some cases be partially or fully hydrogenated. Furthermore, soaps of carboxylic acids, which can be obtained by paraffin oxidation or oxosynthesis, are suitable. Mixtures of soaps of differing origins may also be used.

Examples of synthetic detergent (herein also referred to as syndet) wash active substances are hydrogenated olefin sulfonates or ester salts of sulfosuccinic acid, particularly the alkali metal mono-esters with fatty alcohols having 8 to 20 carbon atoms, such as di-sodium-lauryl-sulfosuccinate or mixtures of olefin sulfonates with disodium-monoalkyl-sulfosuccinates.

The tablets of cleaning agents of the present invention may be produced in accordance with the hitherto conventional processes of soap production. The process is preferably such that the chips of soap or comminuted syndet substances are mixed thoroughly with the branch-chained aliphatic alcohols and/or di-octyl adipate, to be used in accordance with the invention to eliminate the formation of cracks, and with the other mixture constituents, and are converted into the desired form by means of soap milling devices and extruders.

In order to produce soaps having colored patterns, different colored bands or strands of soap can be jointly extruded in an extruder, or colorant solutions can be introduced into the soap mass by way of feeders, which are mounted in the casing of the extruder used to produce the strands of soap, so that only some parts of the total strand of soap are colored. If such strands of soap are cut up and the individual pieces pressed perpendicular to the direction of the colored strands, products are obtained having a marbled effect, which do not pose any greater difficulties with respect to the formation of cracks than conventional monochromatic tablets of soap. During pressing of such colored striped strands of soap parallel to the direction of the strands to produce pieces having symmetrical color patterns, a compression of the strand occurs, thereby considerably increasing the tendency for cracks to form. It is for just such pieces of soap having symmetrical color patterns that the subject matter of the present invention has special significance.

The following examples are intended to describe the subject matter of the present invention in greater detail without, however, restricting it to said examples.

EXAMPLES

Examples using soap as the wash active base substance

In these examples a mixture of 80% sodium tallow soap and 20% sodium coconut soap was used as the wash active base substance. The soap, which is in the form of flakes and has a water content of approximately 13%, was mixed with the additives of the present invention listed hereinafter to improve the resistance to cracking. A colorant solution, in a quantity of approximately 50 g to 100 kg of soap substance, was empressed into the soap mass through the side feeders of an extruder having side feeders, so that a striped coloration of the extruded strand of soap was produced. The strand of soap issuing from the mouth of the extruder was cut up and pressed parallel to the direction of the strand to give pieces having symmetrical color patterns.

The following compounds were used as additives to improve the resistance to cracking in accordance with the invention:

A. Isotridecyl alcohol
B. Branched hexadecyl alcohol from petrochemistry
C. 2-hexyldecanol
D. Iso-octadecyl alcohol
E. 2-octyldodecanol
F. Di-octyl adipate comprising 50% n-octyl and 50% iso-octyl.

The pieces of soap, produced using different quantities of the additional substances, were given to the evaluation personnel in quantities of 10 pieces per person for use under normal conditions. The evaluation of resistance to cracking given hereinafter in Table I is an average value from the individual evaluations.

TABLE I

Evaluation for resistance to cracking of pieces of soap pressed parallel to the strand direction
Evaluation for resistance to cracking in normal use

| Example | Additive with respect to soap | after 3 days | after 8 days | after 14 days |
|---|---|---|---|---|
| comparative | nil | formation of cracks | severe formation of cracks | severe formation of cracks |
| 1 | A 1% | commencing to crack | medium formation of cracks | severe formation of cracks |
| 2 | A 3% | i.o. | commencing formation of cracks | slight formation of cracks |
| 3 | A 5% | i.o. | i.o. | i.o. |
| 4 | A 10% | i.o. | i.o. | i.o. |
| 5 | B 2% | i.o. | commencing formation of cracks | medium formation of cracks |
| 6 | B 4% | i.o. | i.o. | i.o. |
| 7 | B 6% | i.o. | i.o. | i.o. |
| 8 | B 8% | i.o. | i.o. | i.o. |

TABLE I-continued

| Evaluation for resistance to cracking of pieces of soap pressed parallel to the strand direction Evaluation for resistance to cracking in normal use | | | | |
|---|---|---|---|---|
| Example | Additive with respect to soap | after 3 days | after 8 days | after 14 days |
| 9 | C 1% | commencing cracks | medium formation of cracks | medium formation of cracks |
| 10 | C 4% | i.o. | i.o. | i.o. |
| 11 | C 6% | i.o. | i.o. | i.o. |
| 12 | D 2% | i.o. | commencing cracks | slight formation of cracks |
| 13 | D 4% | i.o. | i.o. | i.o. |
| 14 | D 6% | i.o. | i.o. | i.o. |
| 15 | E 2% | i.o. | commencing crack formation | slight crack formation |
| 16 | E 4% | i.o. | i.o. | i.o. |
| 17 | E 8% | i.o. | i.o. | i.o. |
| 18 | F 1% | commencing cracks | slight crack formation | medium crack formation |
| 19 | F 4% | i.o. | i.o. | i.o. |
| 20 | F 6% | i.o. | i.o. | i.o. |
| 21 | F 10% | i.o. | i.o. | i.o. |

(i.o. = in order, no observable change)

It can be seen from Table I that from 4% upwards of any one of the additives inhibit the formation of cracks. In the case of additions of more than 6%, the foam-inhibiting action of the additives begins to have a detrimental effect, and the preferred range therefore lies between 4% and 6%.

Examples using synthetic detergents as the wash active base substances

Syndet pieces based on a mixture of olefin sulfonate and sulfosuccinic ester salt formed the wash active base for these examples. The disodium salt of a sulfosuccinic acid monofatty alcohol ester, which had been produced from the $C_{12}$ to $C_{18}$ fraction of a coconut fatty alcohol, was utilized in the mixture. The olefin sulfonate was derived from a mixture of straight-chain $\alpha$-olefins having 15 to 18 carbon atoms. This olefin mixture had been produced by sulfonation of 1 mol of olefin with approximately 1.2 mols of gaseous sulfur trioxide which had been diluted with inert gas, hydrolysis of the raw sulfonation product with the calculated amount of sodium hydroxide at temperatures of approximately 100° C and bleaching of the sulfonate by means of hypochlorite. The mixture of the two sulfonates contained approximately 5% by weight of neutral salts (sodium sulfate and sodium chloride), with respect to anhydrous sulfonate content. The syndet extrusion mass had the following composition:

70 parts by weight of surfactant mixture comprising
- 60% by weight of the olefin sulfonate
- 40% by weight of the disodium salt of sulfosuccinic acid ester 15 parts by weight of tallow fatty acid (iodine number 2)
2 parts by weight of lanolin
5 parts by weight of water The processing to give the syndet pieces was effected in accordance with the details given for the processing of the soap. In order to determine the resistance to cracking, the evaluation carried out was the same as that for the soap and the results can be seen in Table II.

TABLE II

| Evaluation of resistance to cracking of syndet pieces pressed parallel to the strand direction Evaluation of resistance to cracking in normal use | | | | |
|---|---|---|---|---|
| Example | Additive with respect to surfactant | after 3 days | after 8 days | after 14 days |
| Comparative | nil | i.o. | commencing cracks | slight formation of cracks |
| 22 | A 1% | i.o. | i.o. | commencing cracks |
| 23 | A 3% | i.o. | i.o. | i.o. |
| 24 | B 1% | i.o. | i.o. | i.o. |
| 25 | B 3% | i.o. | i.o. | i.o. |
| 26 | C 1% | i.o. | i.o. | commencing cracks |
| 27 | C 2% | i.o. | i.o. | i.o. |
| 28 | E 1% | i.o. | i.o. | i.o. |
| 29 | F 1% | i.o. | i.o. | commencing cracks |
| 30 | F 3% | i.o. | i.o. | i.o. |

i.o. = in order, no observable change

As can be seen from Table II an addition of 1% of the additive is generally sufficient in the case of tablets of cleaning agents with a syndet base to ensure satisfactory resistance to cracking. An addition of 3% need not be exceeded under any circumstances.

The preceeding specific examples are illustrative of the practice of the invention. It is to be understood however that other expedients known to those skilled in the art, or disclosed herein may be employed without departing from the spirit of the invention or the scope of the appended claims.

We claim:

1. Shaped washing agents based on wash active substances selected from the group consisting of synthetic detergents and soaps consisting essentially of (A) from 54 to 94% by weight of said wash active substances, (B) from 0 to 40% by weight of non-wash active substances customarily incorporated in shaped washing agents, (C) from 5 to 15% water, and (D) from 1 to 10% by weight, of a compound supplying resistance to cracking selected from the group consisting of branched-chain alkanols having from 12 to 20 carbon atoms and di-octyl adipate having up to 50% of n-octyl.

2. The shaped washing agent of claim 1 wherein said washing agent is shaped from colored striped extruded strands pressed parallel to the strand direction.

3. The shaped washing agent of claim 1 based on soap, wherein said compound supplying resistance to cracking is present in an amount of from 4 to 6% by weight.

4. The shaped washing agent of claim 1 based on synthetic detergents, wherein said compound supplying resistance to cracking is present in an amount of from 1 to 3% by weight.

5. The shaped washing agent of claim 1 wherein said compound supplying resistance to cracking is isotridecyl alcohol.

6. The shaped washing agent of claim 1 wherein said compound supplying resistance to cracking is 2-hexyldecanol.

7. The shaped washing agent of claim 1 wherein said compound supplying resistance to cracking is iso-octadecyl alcohol.

8. The shaped washing agent of claim 1 wherein said compound supplying resistance to cracking is 2-octyldodecanol.

9. The shaped washing agent of claim 1 wherein said compound supplying resistance to cracking is di-octyl adipate of 50% n-octyl and 50% iso-octyl.

* * * * *